US005794558A

United States Patent [19]

Loui

[11] Patent Number: 5,794,558

[45] Date of Patent: Aug. 18, 1998

[54] MID FOIL SWAS

[75] Inventor: Steven Loui, Honolulu, Hi.

[73] Assignee: Pacific Marine Supply Co., Ltd., Honolulu, Hi.

[21] Appl. No.: 352,141

[22] Filed: Dec. 1, 1994

Related U.S. Application Data

[63] Continuation-in-part of Ser. No. 159,596, Dec. 1, 1993, Pat. No. 5,433,161.

[51] Int. Cl.[6] ..... B63B 1/24

[52] U.S. Cl. ..... 114/274; 114/265

[58] Field of Search ..... 114/56, 61, 123, 114/283, 274, 265, 267, 266, 275, 277, 280, 282

[56] References Cited

U.S. PATENT DOCUMENTS

| | | | |
|---|---|---|---|
| 3,623,444 | 11/1971 | Lang | 114/61 |
| 4,174,671 | 11/1979 | Seidl | 114/265 |
| 4,919,063 | 4/1990 | Hall et al. | 114/61 |

FOREIGN PATENT DOCUMENTS

| | | | |
|---|---|---|---|
| 0002986 | 1/1977 | Japan | 114/265 |
| 0002987 | 1/1977 | Japan | 114/265 |
| 0002988 | 1/1977 | Japan | 114/265 |
| 0140793 | 12/1978 | Japan | 114/61 |
| 0060788 | 5/1981 | Japan | 114/61 |
| 0085090 | 5/1985 | Japan | 114/61 |
| 0139584 | 7/1985 | Japan | 114/61 |
| 0139585 | 7/1985 | Japan | 114/61 |

*Primary Examiner*—Edwin L. Swinehart

*Attorney, Agent, or Firm*—Fitzpatrick, Cella, Harper & Scinto

[57] ABSTRACT

A high speed ship is disclosed which includes a hull structure having a bow portion and a stern portion with the hull being normally supported above the surface of the water when in operation. A forward strut depend from the bow portion of the hull structure and is subtended by a first transverse displacement foil. A set of midship dual struts depend from the hull structure aft of the forward strut; the aft dual struts are subtended by a second transverse displacement foil extending laterally between and connected to each of said struts. The second transverse displacement foil has a beam equal to or greater than its length and provides 70% or more of the major buoyancy for the ship during operation to maintain the hull above the surface of the water during operation. The forward foil provides less than 30% of the buoyancy of the vessel and has a beam less than the spacing between the aft struts.

29 Claims, 4 Drawing Sheets

FIG. 1
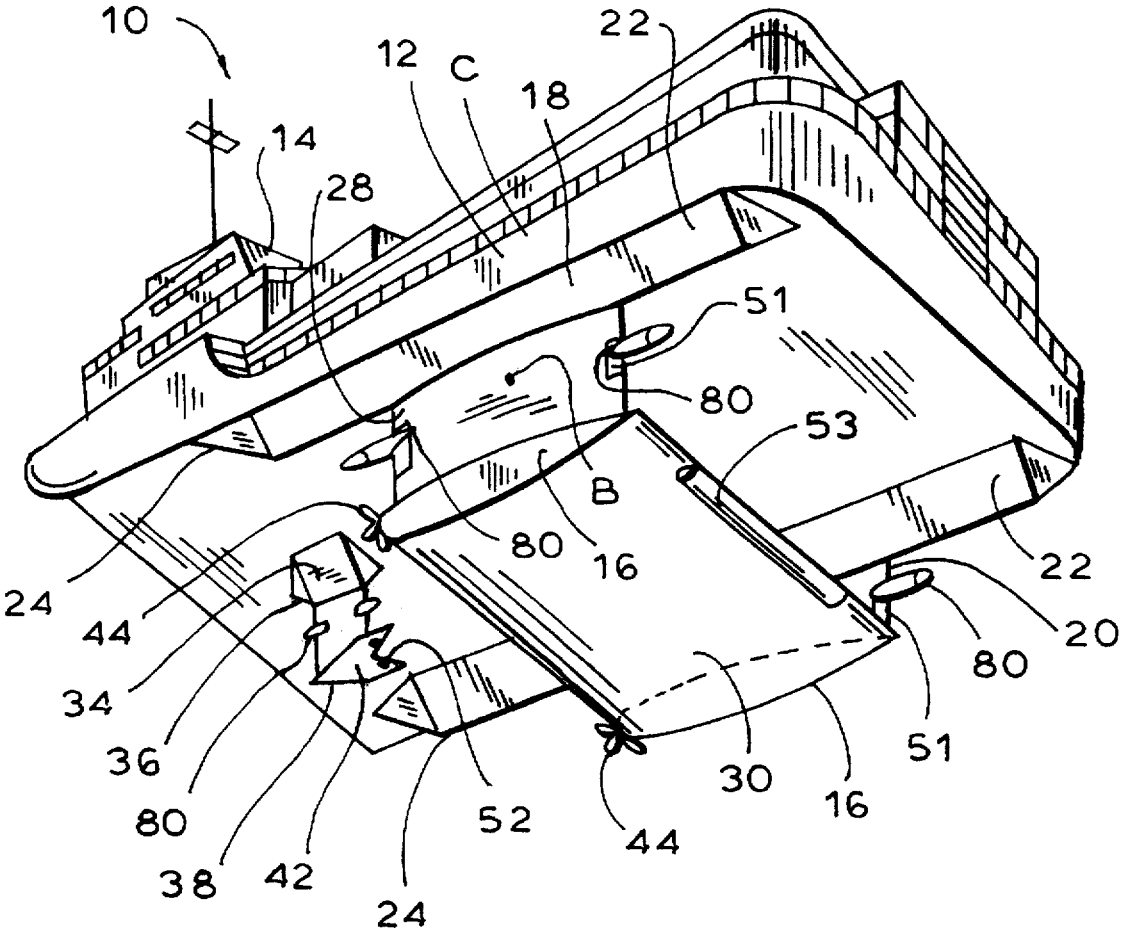
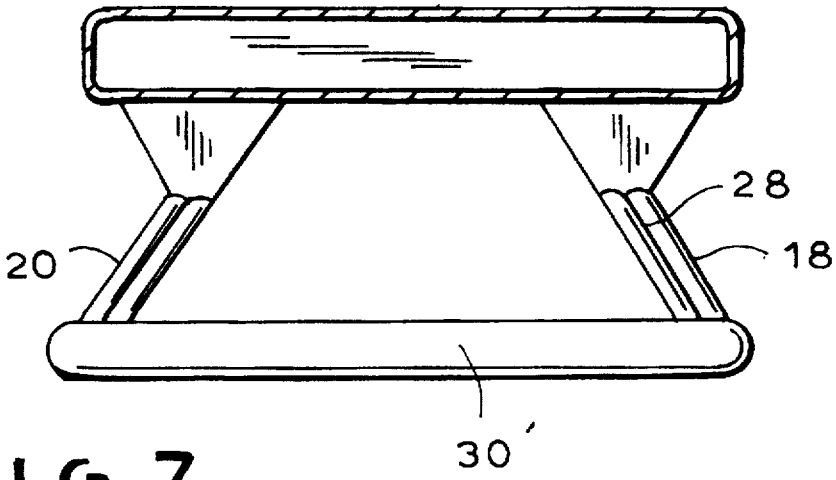
FIG. 7

MID FOIL SWAS

This application is a continuation-in-part of U.S. patent application Ser. No. 159,596, filed Dec. 1, 1993, now U.S. Pat. No. 5,433,161, Jul. 18, 1995.

TECHNICAL FIELD

1. Field of the Invention

The present invention relates to displacement ships of the type referred to in the prior art as semi-submerged ships, i.e. those ships having a load carrying platform supported by water piercing struts attached to submerged hulls.

BACKGROUND OF THE INVENTION

Small waterplane area ships (SWAS) generally consist of a vessel having at least one waterline, located below its design draft, with a waterplane area that is significantly larger than the waterplane area at its design draft. One form of such vessel is a small waterplane twin hull vessel (also referred to as a SWATH vessel) which generally consists of two submerged hulls, originally formed of uniform cross section, connected to a work platform or upper hull by elongated struts which have a cross section along any given waterplane area that is substantially smaller than a waterplane area cross section of the submerged hulls. Thus, at the design waterline, with the hulls submerged, such vessels have a small waterplane area.

SWAS vessels may have one or more lower hulls connected to the work platform or super structure by one or more struts. Originally, SWAS vessels utilized single struts between two submerged hulls and the upper platform, as shown for example in U.S. Pat. No. 3,447,502 issued to Lang, and U.S. Pat. No. 4,552,083 issued to Schmidt. Some time ago, however, the Naval Ocean System Center at San Diego and Honolulu developed a SWAS design characterized by having a least two struts associated with each submerged hull. These vessels are further characterized by submerged twin hulls with uniform cross sections and at least two narrow struts making a connection, at the forward and aft ends of the submerged hulls and the platform. These struts typically extend vertically, as shown for example in U.S. Pat. Nos. 3,623,444 and 3,897,944, issued to Lang. Other forms of such vessels have been disclosed which contain a single lower hull connected by one or more struts to the work platform and vessels having three or more lower hulls connected to the work platform by one or more struts associated with each hull. Other vessels of this general type are also disclosed in U.S. Pat. No. 4,557,211 and Japanese Patent No. 52,987 issued Jan. 11, 1977.

SWAS vessels of this type usually include sponsons (alternatively referred to in the art as upper hulls or upper struts) which are structures positioned above the struts and below the work platform or the super structure that have significantly increasing waterplane areas extending from the strut to the platform. That is, these sponsons are flared hull type structures in cross section having deadrises extending along the length of the vessel. The sponsons may be continuous or segmented over each strut. The struts themselves are generally foil shaped and constant in cross sectional areas. However, as is known in the art, these struts can also be tapered and/or can be canted at negative or positive dihedral angles.

In SWAS vessels, it is desirable to maintain a minimum waterplane area at the design waterline for most efficient operation of the vessel. However, this desirable goal is limited by the need for a minimum waterplane area required to maintain hydrostatic stability. As a result, existing SWAS vessels commonly have a problem with trim and heel stability due to the small waterplane area of the struts. These vessels also suffer from high frictional drag due to relatively large surface areas formed by the struts despite every effort that has been made to minimize this.

Previously proposed semi-submerged vessels use an arrangement of elongated (small cross-sectional area to length) submerged hulls to provide the majority of the buoyancy. For efficient operation from the standpoint of powering and fuel consumption, SWATH, as with all displacement ships, are presently limited in speeds to those having a Froude number of less than 0.4.

Froude number (F) is defined as follows:

$$F = \frac{v}{\sqrt{gl}}$$

where v=speed g=acceleration due to gravity l=length of hull.

The limit in speed of a displacement ship is best described in *Modern Ship Design*, by Thomas C. Gillmer, 1970 which states, "The practical limiting speed for displacement surface vessels is basically that of wavelength to ship length, where one wavelength, created by the ship, is equal to the ship's waterline length.

This, expressed quantatively, is $V/\sqrt{L}$~1.3 (or F=0.39), and V is sometimes called the hull speed. When a surface ship attempts to exceed this speed it finds itself literally climbing a hill that it is creating. In exceptional cases of slim, highly powered ships such as destroyers, it is possible to exceed this speed, but it is seldom profitable."

The limitation in speed is primarily due to the large increase in wave resistance that occurs between a Froude number of 0.4 and 0.8. This increase in wave resistance is well established in the prior art for all surface displacement ships and is often referred to as the resistance or powering "hump." See *Fluid-Dynamics Resistance*, by Sighard F. Hoerner, 1965. Because of the high wave resistance, operation in the "hump" speed region results in high propulsion power and inefficient fuel usage. According to Gilmer, supra, "A ship may be required to maintain a constant operational speed for long periods and it is clearly desirable that it should not do so at a hump on the Cw (wave drag) curve" (pg. 160). Normal operation for a displacement ship is at a Froude number corresponding to a "hollow" in the wave drag curve at a Froude number lower than the primary hump. The operational Froude number for various ship types is shown in FIG. 5.22 of Mechanics of Marine Vehicles, Clayton and Bishop, p. 220 and table A page 11–15, Hoerner, supra. Only the destroyer with its abundance of power operates at a Froude number above 0.4.

To delay the onset of high wave making resistance the prior art calls for:

"as long a length as is compatible with other de sign requirements," Principles of Naval Architecture, Comstock, p. 345;

"greater length will reduce wave-making resistance but increase the frictional resistance," Comstock, p. 342; and "vessels . . . are made as long and slender as practicable," Hoerner, p. 11–12.

Operation at a Froude number greater than 0.8 substantially reduces wave resistance. "The pressure distribution about a high speed vehicle is therefore quite similar to that about a vehicle progressing at a very low speed . . . This means that the wave making resistance of high speed vehicles (Fr≧1.5, say) is small as it is for vehicles operating at very low speeds (Fr≦0.15, say)" Clayton and Bishop, p. 219; however, to exceed the "hump" speed region requires excessive propulsion power for displacement (including SWATH) ships of the conventional form.

Recently it has been found that a small waterplane area hull form which operates at reduced wave resistance and permits efficient operation to high speeds, that is, where the Froude number is greater than 0.8, can be provided using streamlined struts and streamlined foils extending transversely between the struts which have a significantly reduced stream wise length, when compared to elongated hulls of the conventional design. This arrangement will effectively increase the Froude number at a given speed.

Two additional concepts that have been advanced to achieve high speeds with good seakeeping are a hybrid SWATH hullform, or HYSWATH and a hybrid catamaran hull form, or hycat (or foilcat, catafoil or hysucat). Both concepts attach one or more hydrofoils to the underwater hulls. At rest and at low speeds these vessels' struts or catamaran hulls are immersed to a relatively deeper draft to maintain sufficient submerged volumes to buoyantly support the vessel. Above certain critical speeds the hydrofoil(s) generate sufficient hydrodynamic lift to partially raise the vessel to a shallower draft. The partial lifting of the vessel raises the struts or catamaran hulls along their entire waterline length to a shallower draft raising previously submerged sections out of the water, thus reducing the wetted surface area frictional drag. The raising of the struts or catamaran hulls to a shallower draft further reduces residual resistance by reducing the amount of submerged volume and cross sectional area of struts and catamaran hulls which are generally tapered or flared (V shaped cross sections). The a mount of dynamic lift of the hydrofoil(s) is a design variable that ranges from 30% to 90% of the vessels full load displacement.

All prior hull forms discussed thus far have the vessel's waterplane areas distributed longitudinally and transversely to provide required flotation to maintain hydrostatic stability. The waterplane areas of the water piercing struts or hull sponsons are typically vertically aligned above the vessels buoyant submerged hulls. The vessel's center of buoyancy is necessarily aligned with the vessels center of gravity and the typical arrangement of the waterplane area also results in alignment of the center of flotation.

It is an object of the present invention to provide an improved SWAS vessel which can operate efficiently at high speeds.

Another object of the invention is to provide a SWAS which has higher propulsive efficiency as compared to the prior art.

Yet another object of the present invention is to provide a SWAS vessel with a higher deadweight to lightship ratio as compared to the prior art.

A further object of the invention is to produce a SWAS vessel with reduced structural loads, a low wake at high speeds and improved control of motions.

DISCLOSURE OF INVENTION

The present invention deals specifically with a unique construction of a SWAS utilizing a single main traverse displacement foil located below the design waterline at approximately midship or just aft of midship between a pair of depending struts to provide the principal buoyancy for the ship to maintain the platform of the vessel above the surface of the water during operation. It may also provide hydrodynamic lift and house the propulsion system. A third forward strut is provided at the bow of the ship and depending from it is a small submerged pod or foil. This forward submerged pod or foil provides stability to the vessel for static and dynamic control but only a small portion of the vessel's buoyancy. Control surfaces can be located on either or both foils and all struts. Adequate waterplane area to meet hydrostatic stability requirements with minimum resistance is achieved by the water piercing struts and can be augmented by additional strategically placed "flotation" struts depended from the vessel platform or sponsons.

The construction of the present invention represents a significant advance over existing ship designs for rough water missions at high speeds. Compared to other SWAS ships, the present invention will have lower resistance and drag, higher propulsive efficiency, improved sea keeping and sea kindliness, higher deadweight to lightship ratio, reduced structural loads and enhanced hydrostatic and hydrodynamic stability. The most important design principle is to keep the stream wise length of all elements submerged below the design waterline such that at design operating speed the elements are operating at Froude number 0.8 or greater, preferably at Froude number equal to or greater than 1.5.

The design achieves these advantages by using the unique characteristics of semi-submerged ships to arrange the distinct properties of buoyancy (displacement) and flotation (waterplane area) to optimize resistance, seakeeping and stability. As stated previously, existing hull forms such as SWATHs, monohulls and catamarans have their flotation vertically aligned over their buoyancy. Such a practice while structurally simple does not allow for design optimization. Flotation is needed principally for hydrostatic stability while its shape and location impacts motions. Buoyancy is needed to support the displacement of the ship at its center of gravity while the volumes and cross sectional areas of the submerged form impact hull resistance. Hull forms such as outrigger canoes and trimarans have recognized, in part, the benefits of separating the issues of buoyancy and displacement. The main hulls in these craft are designed to minimize resistance by having high length to beam ratios and the resulting heeling sensitivity is dealt with by having widely spaced smaller outer hull(s) that provide little displacement but much outboard flotation for transverse stability. Most displacement vessels for resistance, seakeeping, intact and damage stability reasons have their centers of gravity, buoyancy and flotation at approximately midship or just aft of midship.

The present invention arranges buoyancy (displacement) to minimize resistance while maintaining good seakeeping and intact and damage stability features. The main foil and pair of struts it depends from support the majority of the displacement (70% or greater) at approximately midship or just aft of midship, coinciding with the intended midship center of gravity and center of flotation so there are no adverse motions caused by coupled moments. In regards to resistance, firstly, a foil shape minimizes drag. Secondly, frictional drag is reduced for an equal displacement SWAS vessel since a single large transverse displacement foil can be designed to have less wetted surface area than two smaller foils or the twin cylindrically shaped hulls of a SWATH. Thirdly, the short stream wise length of the transverse foil and strut it is depended from results in high operational Froude numbers giving it significantly reduced wavemaking resistance.

The present invention arranges flotation to satisfy intact and damage stability requirements while minimizing motions and resistance. If required, the waterplane area of the water piercing midship and forward struts can be augmented by depending "flotation" struts from the vessel platform or sponsons. To keep the struts small and lightweight the struts are depended at the outboard bow and stern locations of the platform to achieve the greatest longitudinal and transverse righting moments. These flotation struts depend to approximately the vessel's design waterline or just below the waterline, but ideally depend to about six inches above the waterline. To minimize slamming and spray, the struts are streamlined with a very sharp angle of entry and a high degree of deadrise. All struts may also incorporate buoyancy pods at or slightly above the waterline and accrue the advantages of that design element. The use of flotation struts and buoyancy pods to augment flotation when needed for static stability allows the invention to optimally use only a single forward water piercing foil which helps reduce the wetted surface area frictional drag compared to SWAS designs that are configured with two water piercing forward struts for trim stability.

The present invention's strategically placed forward strut and foil is designed to interact with the main foil and struts in order to enhance seakeeping, resistance and stability. By locating it at the bow, the strut's waterplane area provides the maximum trim moment for stability, the maximum trim moment when the forward foil is ballasted and the maximum trim moment when active submerged control surfaces are employed to control motions while underway. Additionally, the location allows for maximizing the steering moment when strut leading and/or trailing edges are employed as active steering control surfaces. Also, by selective sizing and strategic separation of the forward strut and foil from the main strut and foil, destructive interference of the respective wavemaking systems can be achieved to reduce wavemaking resistance at certain critical speeds. This is accomplished by having the leading edge of the main strut placed at a longitudinal distance from the leading edge of the forward strut by an odd number of forward strut spacings (i.e. 1,3,5,7). At these spacings, at the critical large wavemaking speeds of the forward strut, the trough of the bow wave from the forward strut will destructively interfere with the crest of the bow wave of the main strut, resulting in reduced resistance at this critical speed.

Having a single forward strut with a small foil leaves the outboard portions of the midship buoyancy foil unobstructed so that the propellers of the propulsion drivetrain can be located at the forward edges of the midship foil in a tractor propulsion arrangement. Because of the undisturbed water encountered by the propellers, the efficiency of the propulsion system is increased. Alternatively, the clean flow and pressure gradients at the leading edge of the strut to foil intersection make a highly efficient waterjet propulsion system also feasible.

The present invention has a lighter structural weight and a greater payload than comparable displacement SWAS ships. Firstly, since the main foil will have less surface area compared to another comparable displacement SWAS ship it will have less material and thus less weight. Similarly, having only a single forward strut instead of a tandem arrangement reduces the amount of structure. Secondly, the transverse foil configuration results in a lighter cross structure to handle the large lateral forces encountered by all semi-submerged ships. This is because connecting the struts with the transverse foil distributes the lateral load across two cross structures and reduces the large bending/prying moment at the top of the strut cross structure joint inherent in a configuration where a longitudinal hull or pod depends from struts.

Other benefits of the present invention are improved motion control at speed by utilizing movable leading and trailing edges of foils and struts to create large hydrodynamic lifting forces to actively attenuate wave excited ship motions. In addition, if active control surfaces are placed on the trailing edges of the midship strut, this would allow the ship to attenuate sway motions that are presently not able to be controlled by existing ships. Compared to SWAS designs that have separate active stabilizers and rudders, the present invention does not have to bear the additional weight and drag of the appendages.

Depending upon speed and submergence the present invention will encounter cavitation problems with its submerged foils. To counter this problem, a thinner foil with less displacement and greater hydrodynamic lift can be incorporated into the invention, especially if higher speeds are required. In this configuration at rest and up to its critical lift speed, the foil carrying and flotation struts will be submerged to a deeper draft. At its design speed, the submergence of the struts will be reduced and the flotation struts should be completely out of the water or minimally immersed. While similar in concept when compared to hybrid catamaran-hydrofoil designs, the present invention at design speed does not rely on the buoyancy of the partially immersed high length to beam catamaran hulls but rather the buoyancy of the submerged foil. Thus, this gives the invention the benefit of less wetted surface area. Also, since the present invention uses short streamwise length foil and strut elements, compared to the hybrid catamaran-hydrofoil designs it will retain the benefit of having element spacings for destructive wave making interference and retain the benefit of reduced wave making resistance when operating at Froude numbers of its elements in excess of 0.8, and preferably greater than or equal to 1.5.

Because of the increased speeds the vessel can achieve as a result of the reduced drag and improved propulsive efficiency the vessel demonstrates improved overall transport efficiency. This is defined as (Payload×Speed)/Horsepower. As a result of the lighter structural weight, a higher payload can be carried as compared to a prior art vessel of the same displacement without reducing efficiency or, the required horsepower for the same speed and payload may be reduced.

Finally, because the invention operates at high Froude numbers relative to the streamwise length of all its elements, the vessel generates very little wavemaking at its design operating speeds in excess of Froude number 0.8. This results in the benefit of a low vessel wash which is increasingly becoming a concern because of wash caused erosion along shoreline and harbors.

The above, and other objects, features and advantages of this invention will be apparent to those skilled in the art from the following detailed description of illustrative embodiments of the invention which is to be read in connection with accompanying drawings, wherein:

BRIEF DESCRIPTION OF THE DRAWINGS

FIG. 1 is a perspective view of a MID FOIL SWAS vessel constructed in accordance with the present invention;

FIG. 7 is a front view similar to FIG. 5 of another embodiment of the invention;

DETAILED DESCRIPTION OF THE PREFERRED EMBODIMENT

Figure 2:
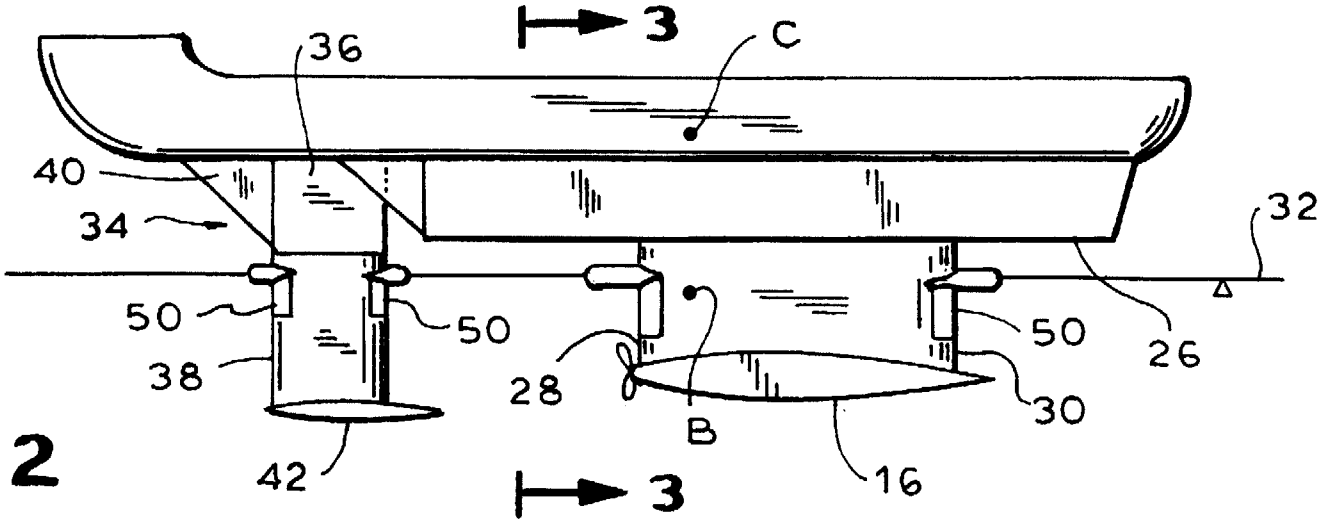
FIG. 2 is a side view of the vessel shown in FIG. 1.

Referring now to the drawings in detail, and initially to FIG. 1, a SWAS vessel 10 constructed in accordance with the present invention is illustrated which includes a main upper platform or hull 12 on which a schematically illustrated superstructure 14 is mounted. The vessel includes a normally submerged foil 30 subtended from a pair of struts 18, 20 on opposite sides of the vessel and connected approximately just aft of midship between platform 12 and foil 30. Platform 12 includes a pair of sponsons 22 located on either side of the platform and to which struts 18, 20 are connected. In this illustrative embodiment of the invention sponsons 22 extend substantially the full length of the hull or platform 12, functioning as a longitudinal box beam and connected to sharply angled bow section 24. The sponsons 22 are thin relative to the beam of the vessel and are flared as illustrated in FIG. 1 to provide additional buoyancy to the vessel should the struts 18, 20 become fully submerged. Because of the sharp entry 24 and high deadrise of the sponsons when they encounter waves in unusually high seas they will not only provide increased buoyancy but also reduce the slamming and pounding that sometimes occurs with more conventional SWATH vessels.

Figure 3:
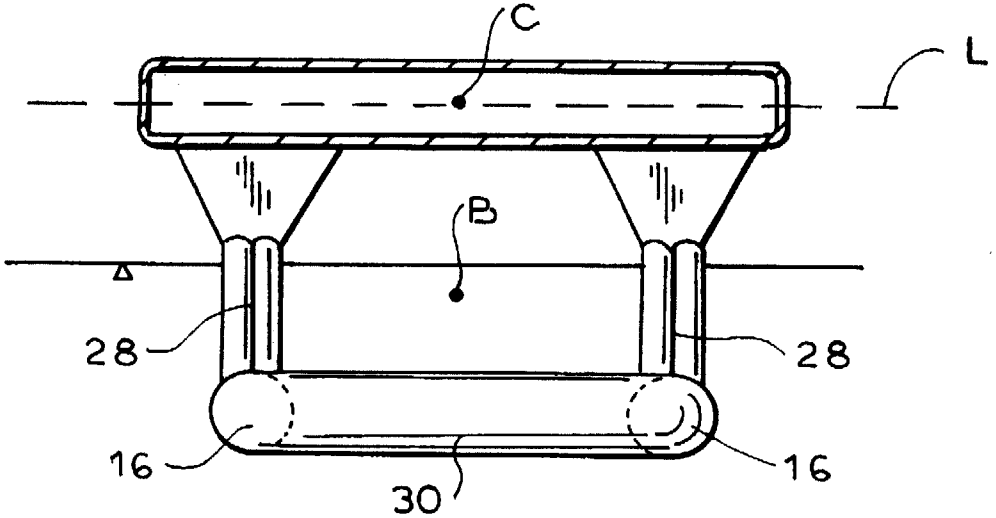
FIG. 3 is a front view taken along line 3—3 of FIG. 2.

Struts 18, 20 are generally located at or just aft of midship on the vessel and may extend vertically from sponsons 22, as shown in FIG. 3. Alternatively, they may be angled or positioned at positive or negative dihedral angles, as shown for example in FIGS. 5 and 7. The struts are preferably thin in width and streamlined in shape, having tapered leading or forward edges 28. The struts may be uniform in cross section or tapered so that their waterplane area decreases from their point of connection to sponsons 22 toward foil 30. This taper can be either longitudinal or transverse, or both as desired. Attached to struts 18, 20 are buoyancy pods 80, described in greater detail hereafter.

In accordance with the embodiment of the invention illustrated in FIGS. 1–3, the buoyancy means or foil 30 is subtended from struts 18, 20. The buoyancy foil 30 is a rigid hollow member which provides the major buoyancy for the vessel, i.e. 70% or more. It is located below the design waterline 32 of the vessel at all times that the vessel is in the water. While the buoyancy foil is shown as being a constant cross sectional, straight foil it may also be a swept wing shape, it may vary in chord thickness across the span, or it may be mounted in a dihedral or anhedral angle from the strut to the centerline. The center of gravity C of the vessel is aligned with the center of buoyancy B of the combined buoyancy foil 30 and forward trim foil 42.

Vessel 12 also includes a forward sponson and strut structure 34 which includes a short tapered sponson 36, vertical strut 38 and at least one or more buoyancy pods 80 on the strut. Sponson 36 is a hollow member similar to sponsons 22 and is located along the centerline of the vessel. It has a tapered bow portion which functions like the bow portions 24 of sponsons 22 to provide reduced slamming in high seas.

Attached to the leading and trailing edges of strut 38 and the leading edges of struts 18, 20 are buoyancy pods 80. Buoyancy pods 80 are hollow structures, diamond shaped in cross section as described for example in U.S. patent application Ser. No. 159,596. The pods also may be of any of the other shapes described in application Ser. No. 159,596. Preferably, they are located on the struts below the bottom of the sponsons to provide additional flotation and buoyancy whenever the strut becomes completely submerged. In a seaway its shape provides a wave-piercing action such that large wave excitation moments are not generated. Use of buoyancy pods in combination with high deadrise sponsons reduces slamming while still providing the required buoyancy and flotation compared to wide sponsons with greater cross sectional area. Buoyancy pods also effectively deflect spray coming off the struts and therefore reduce spray drag. Buoyancy pods may also be attached to the flotation struts described hereinafter.

The single forward strut 38 depends from sponson 36 to below the design waterline of the vessel. A small buoyancy foil 42 is subtended from (i.e. mounted on) the lower end of strut 38. In this embodiment foil 42 is generally deltoid in shape (see FIG. 1) and preferably has a deeper submergence than foil 30. However, it may also be located at the same depth or waterplane as foil 30. Alternative to the deltoid shape illustrated foil 42 could be a cylindrical pod with canards, or a rectangular or dihedral foil. It is a hollow member constructed to provide the balance of the required buoyancy of the vessel, i.e. 30% or less. This strut and foil provide trim stability and proper alignment of the centers of gravity, buoyancy and flotation to provide improved static and dynamic stability to the vessel.

Preferably the maximum width of the foil 42 is less than the internal spacing between struts 18, 20 so that the leading edges of foil 30 encounter free or undisturbed water as the vessel is underway. This permits the propellers 44 of the vessel to be arranged at the leading edge of foil 30 to operate in a tractor arrangement. This greatly increases the propeller efficiencies and the effectiveness of the vessel's control surfaces. Of course, if desired, the propellers may be located at the trailing edge of the foil 30 in a conventional pusher arrangement. Alternatively, a water jet propulsion system can be used.

By utilizing selective, movable leading and trailing edges on the foils 30 and 42 and struts 38, 18 and 20, large hydrodynamic lift forces can be generated over these surfaces to control the vessel. Movable leading edge 50 on strut 38 generates lift over the strut to steer the vessel. Movable trailing edges 51 of struts 18 and 20 generate lift over the struts to control sway motions. Movable trailing edges 52 of foil 42 generate lift over the foil to control pitch and heave motions. Movable trailing edges 5 of foil 30 generates lift that can control roll, pitch and heave motions. These movable edges can be formed and installed in any convenient manner as would be apparent to those skilled in the art.

Figure 8:
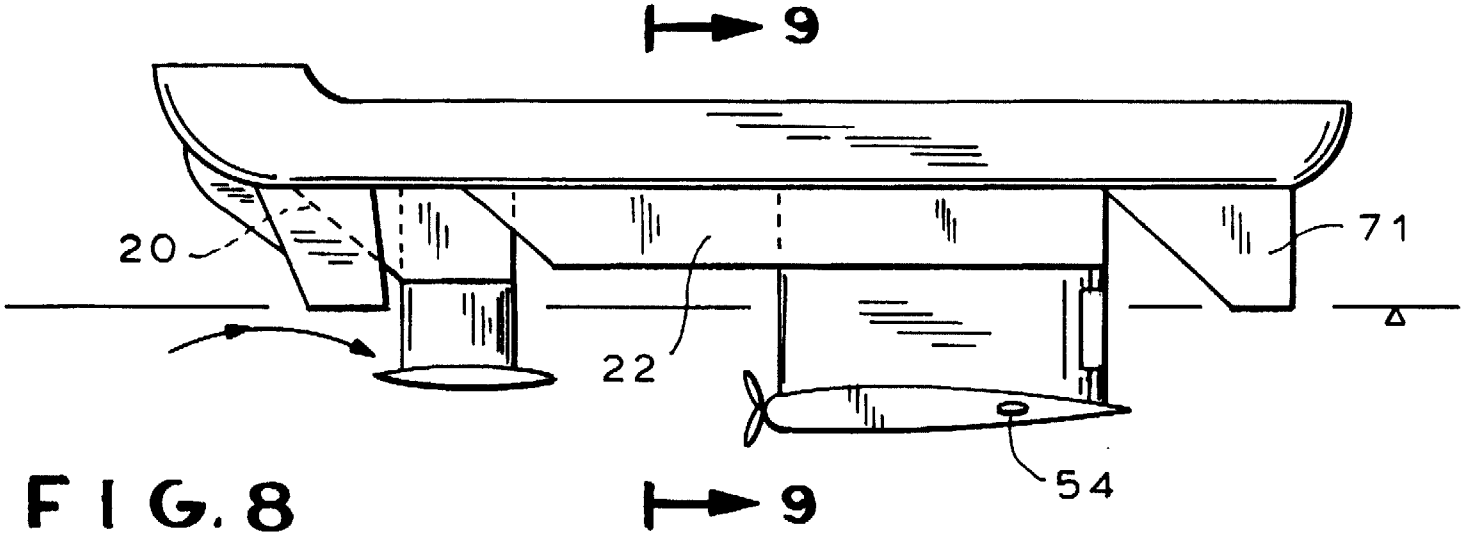
FIG. 8 is a side view similar to FIG. 4 of an embodiment of the invention in which the struts are not connected to the sponsons.
Figure 9:
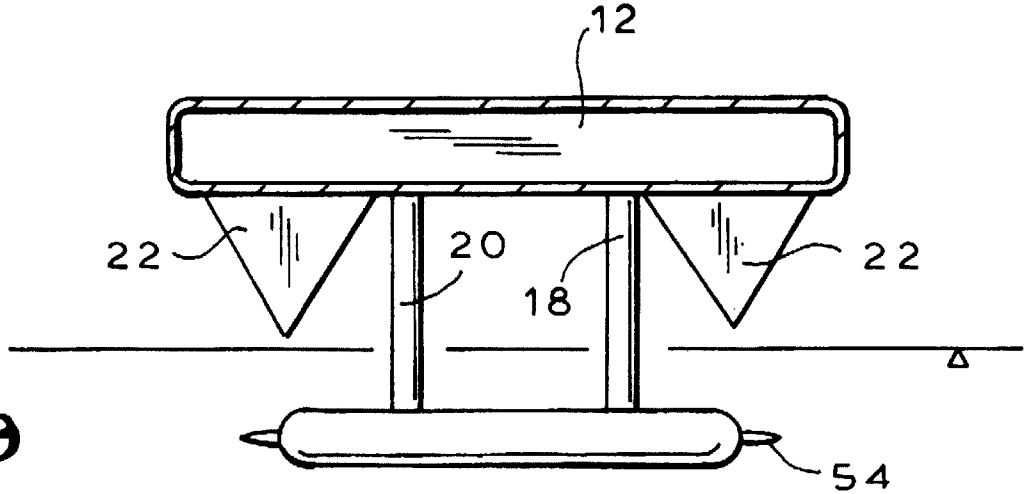
FIG. 9 is a front view taken along line 9—9 of FIG. 8.

If desired additional thin stabilizers 54 may be provided on the aft buoyancy foil as shown, for example in the embodiment of FIGS. 8 and 9.

The specific dimensions of the components of the vessel 10 can be varied as desired by the designer to meet the required operating characteristics of the vessel. However, it is preferable that the major buoyancy, 70% or more, for the vessel be provided by main foil 30. The foil thickness should be approximately 20% of its chord length, however, the faster the design operating speed the correspondingly thinner the foil should be to reduce cavitation. In addition, it has been found that the main foil member 30 should have a span equal to or greater than its longitudinal chord. In one embodiment, for a 65 foot LOA vessel this accomplished with a main foil that has a span of 30 feet, chord of 22.5 feet and thickness of 4.5 feet. In order to provide destructive wave making interference, the forward strut is 10 feet long and the leading edges of the two main struts are located longitudinally 30 feet (3 forward strut lengths) from the leading edge of the forward strut.

Figure 4:
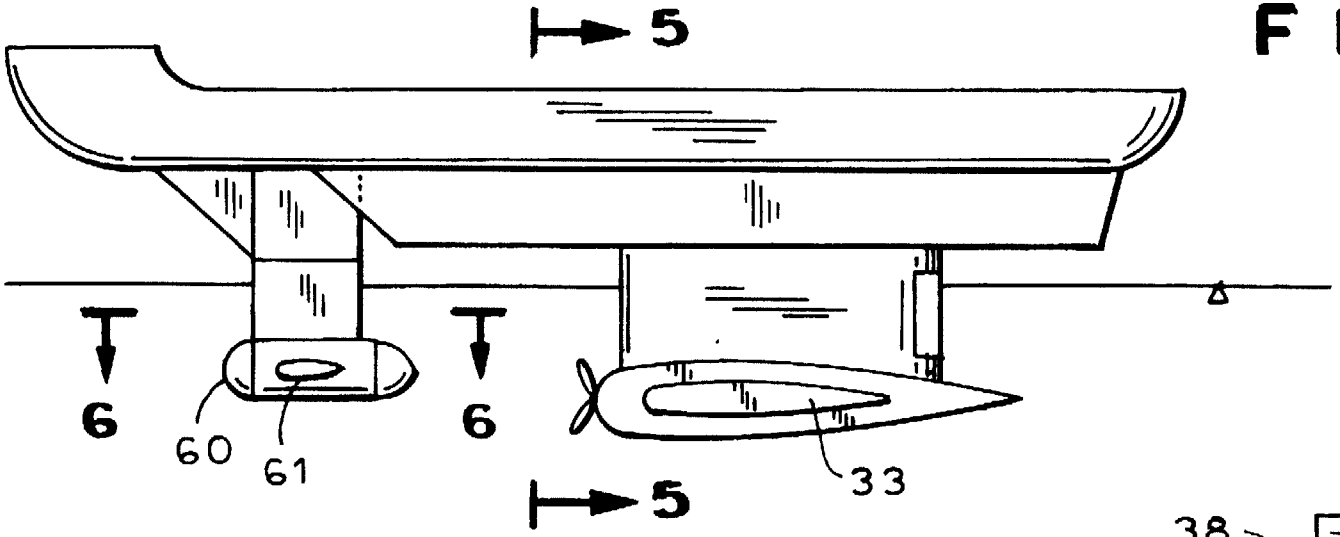
FIG. 4 is a side view of another embodiment of a MID FOIL SWAS constructed in accordance with the present invention.
Figure 6:
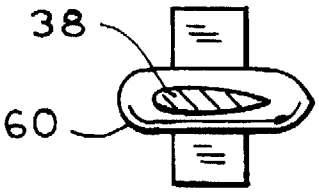
FIG. 6 is a sectional view taken along line 6—6 of FIG. 5.
Figure 5:
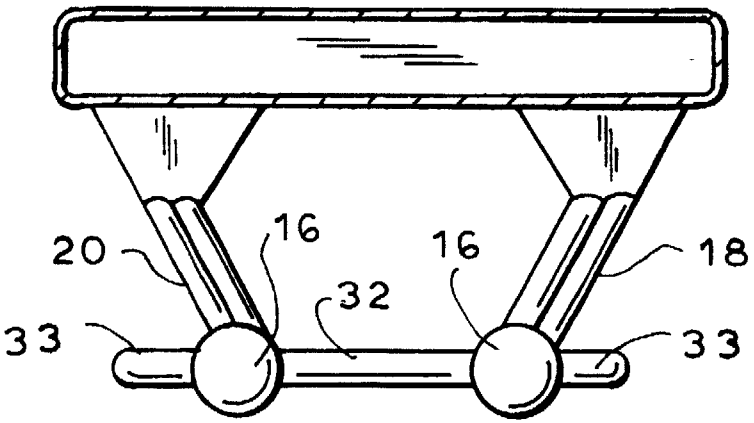
FIG. 5 is a front view taken along line 5—5 of FIG. 4.

Another embodiment of the invention is illustrated in FIGS. 4–6, wherein like numerals correspond to like parts of the embodiment of FIGS. 1–3. In this embodiment struts 18, 20 are positioned at an inward negative dihedral angle and are subtended by hulls 16. The foil 32, in this case, has a smaller height than the diameter of hulls 16 but extends laterally beyond the hulls to outboard foil portions 33. As with the previously described embodiment both the sponsons and the struts 18, 20, may flare longitudinally or transversely above the waterline to provide increased waterplane area above the design waterline that will provide increased buoyancy in certain conditions. Also like the previously described embodiment, buoyancy pods 80 (not shown) can be attached to the struts.

In the embodiment of FIGS. 4–6, a generally cylindrical supplemental hull 60 is used in lieu of foil 42. This supplemental hull serves the same function as foil 42, i.e., it provides some buoyancy for the vessel (less than 30%). It may be provided with a laterally extending stabilizers (canards) 61 or the like whose position or angled attack may be adjustable.

FIG. 7 illustrates an embodiment of the invention wherein the main buoyancy means 30' is also a foil. Struts 18, 20 are shown in their positive dihedral configuration. That configuration may be used with any of the embodiments.

Struts 18, 20 do not necessarily have to depend directly from sponsons 22. In the embodiment of the invention illustrated in FIGS. 8 and 9, struts 18, 20 depend directly from vessel hull 12, with the sponsons located outboard thereof. This embodiment also illustrates the use of additional forward and aft pairs of laterally floatation struts 70, 71 which depend from the hull at the corners of the vessel to points preferably slightly above the design waterline of the vessel. These may also have buoyancy pods 80 located on them for additional buoyancy if the struts become submerged. Alternatively a single midship buoyancy strut may be used.

Two factors important to the design of vessels of the present invention are the streamwise length and spacing of the hull components. Vessels of the present invention are configured such that all submerged hull elements (struts, foils and pods) are short in streamwise length and at design speeds have Froude numbers equal to or greater than 0.8 and preferably greater than or equal to 1.5. Also, to further reduce wave making resistance at critical speeds, the forward strut and main struts are spaced such that there is destructive wave making, interference between their respective bow waves.

Although several illustrative embodiments of the invention have been described herein, it is to be understood that various changes and modifications may be effected therein by those skilled in the art without departing from the scope or spirit of the invention.

What is claimed is:

1. A high speed ship comprising a hull structure having a bow portion and a stern portion and being normally supported above the surface of the water at a design waterline when in operation, a forward strut depending from the bow portion of the hull structure subtended by a first buoyancy means, a pair of aft dual struts depending from the hull structure at approximately midship, said aft struts being subtended by a second buoyancy means whose beam is equal to or greater than its length extending laterally all the way between said struts; said aft struts and said second buoyancy means providing more than 70% of the buoyancy for the ship during operation to maintain said hull structure above the surface of the water during operation and said forward strut and first buoyancy means providing 30% or less of the buoyancy of the vessel during operation; and wherein the center of buoyancy of the ship is located within the periphery of the second buoyancy means when viewed from above.

2. A high speed ship as defined in claim 1 wherein said forward buoyancy means comprises a foil shaped member.

3. A high speed ship as defined in claim 2 wherein said foil shaped member is generally deltoid shaped in plan form.

4. A high speed ship as defined in claim 2 wherein said foil shaped member is positioned to be deeper in the water than said second buoyancy means.

5. A high speed ship as defined in claim 1 wherein said forward buoyancy means includes movable ship control surfaces.

6. A high speed ship as defined in claim 1 wherein said forward strut has increasing waterplane area sections above the design waterline of the ship.

7. A high speed ship as defined in claim 1 wherein said forward buoyancy means has a width that is less than the transverse spacing between said aft pair of struts.

8. A high speed ship as defined in claim 1 wherein said first buoyancy means is a generally cylindrical hull member.

9. A high speed ship as defined in claim 8 including foil shaped stabilizers extending laterally from said first buoyancy means.

10. A high speed ship as defined in claim 1 wherein said pair of aft struts are positioned at dihedral angles to said hull structure.

11. A high speed ship as defined in claim 1 wherein said second buoyancy means comprises a pair of generally cylindrical pods subtended respectively from said aft dual struts and a displacement foil extending there between, said pods and foil providing more than 70% of the buoyancy for said ship.

12. A high speed ship as defined in claim 11 wherein said foil has a height dimension less than that of said pods.

13. A high speed ship as defined in claim 1 wherein said second buoyancy means comprises a displacement foil connected to said struts, said foil providing more than 70% of the buoyancy of said ship.

14. A high speed ship as defined in claim 7 including propulsion means in said second buoyancy means including propellers located on the forward end of the second buoyancy means outboard of said first buoyancy means.

15. A high speed ship as defined in claim 1 including a pair of elongated sponsons depending from said hull to a position adjacent the design waterline of the ship for providing hydrostatic transverse and longitudinal stability to the ship when said design waterline is submerged.

16. A high speed ship as defined in claim 15 wherein said sponsons are outboard of said pair of struts.

17. A high speed ship as defined in claim 1 including at least one forward and one aft flotation strut depending from said hull structure to a point above the design waterline of the ship when in operation.

18. A high speed ship comprising a superstructure normally located above the level of the water during operation of the ship, a forward strut depending from said superstructure to a position below the design waterline of the ship; a pair of struts depending from said superstructure aft of the forward strut to a position below the design waterline of the ship; forward normally submerged buoyancy means for providing buoyancy to the ship connected to said forward strut below the design waterline of the ship; and aft buoyancy means connected to said pair of struts below the design waterline of the ship for providing more than 70% of the ship's buoyancy, said buoyancy means both being submerged when the ship is at rest and when it is underway; said second buoyancy means comprising a displacement foil connected to said struts, said displacement foil providing more than 70% of the buoyancy of said ship.

19. A high speed ship as defined in claim 18 wherein said forward buoyancy means comprises a foil shaped member.

20. A high speed ship as defined in claim 19 wherein said foil shaped member is generally deltoid shaped in plan form.

21. A high speed ship as defined in claim 19 wherein said forward strut has increasing waterplane area sections above the design waterline of the ship.

22. A high speed ship as defined in claim 18 wherein said foil shaped member is positioned to be deeper in the water than said second buoyancy means.

23. A high speed ship as defined in claim 18 wherein said pair of aft struts are positioned at dihedral angles to said hull.

24. A high speed ship as defined in claim 18 wherein said second buoyancy means comprises a pair of generally cylindrical pods subtended respectively from said aft dual struts and a displacement foil extending therebetween, said pods and foil providing more than 70% of the buoyancy for said ship.

25. A high speed ship as defined in claim 18 including propulsion means in said second buoyancy means including propellers located on the forward end of the second buoyancy means outboard of said first buoyancy means.

26. A high speed ship as defined in claim 25 including a pair of elongated sponsons depending from said hull to a position adjacent the design waterline of the ship for providing hydrostatic transverse longitudinal stability to the ship.

27. A high speed ship as defined in claim 26 wherein said sponsons have waterplane areas which increase above the design waterline of the ship.

28. A high speed ship as defined in claim 27 wherein said struts and buoyancy means have a length dimensions from bow to stern determined by the formula $$F = \frac{v}{\sqrt{gl}}$$

where

F=design Froude number

V=design speed of the small waterplane area high speed ship in feet per second l=longitudinal length of the struts in feet g=acceleration due to of gravity in feet per second squared and the design Froude number is 0.8 or greater, said second buoyancy means providing more than 70% of the buoyancy for the ship during operation to maintain said hull above the surface of the water in a generally level attitude with the first buoyancy means providing less than 30% of the buoyancy for the ship.

29. A high speed ship as defined in claim 18 including at least one forward and one aft flotation strut depending from said hull structure to a point adjacent the design waterline of the ship when in operation.

* * * * *